US007479889B2

(12) United States Patent
Kazdin et al.

(10) Patent No.: US 7,479,889 B2
(45) Date of Patent: Jan. 20, 2009

(54) LOCATOR SYSTEM

(75) Inventors: Ronald S. Kazdin, 11900 Kinsman Rd., Newbury, OH (US) 44065; Thomas J. Radu, 17 Woodside Rd., Chagrin Falls, OH (US) 44022

(73) Assignees: Ronald S. Kazdin, Chagrin Falls, OH (US); Thomas J. Radu, Chagrin Falls, OH (US)

( * ) Notice: Subject to any disclaimer, the term of this patent is extended or adjusted under 35 U.S.C. 154(b) by 185 days.

(21) Appl. No.: 11/417,712

(22) Filed: May 4, 2006

(65) Prior Publication Data

US 2007/0013526 A1 Jan. 18, 2007

Related U.S. Application Data

(63) Continuation-in-part of application No. 10/676,452, filed on Oct. 2, 2003, now Pat. No. 7,042,361.

(51) Int. Cl.
*G08B 23/00* (2006.01)

(52) U.S. Cl. ..... 340/573.1; 340/539.1; 340/568.1; 340/539.11

(58) Field of Classification Search ..... 340/573.1, 340/539.1, 825.49, 825.54, 568.1, 825.36, 340/539.13, 10.1, 545.4, 539.11
See application file for complete search history.

(56) References Cited

U.S. PATENT DOCUMENTS 4,745,882 A * 5/1988 Yarnall et al. ..... 119/721
5,161,485 A * 11/1992 McDade ..... 119/859
5,652,570 A * 7/1997 Lepkofker ..... 340/573.4
5,714,932 A * 2/1998 Castellon et al. ..... 340/539.11
5,742,233 A * 4/1998 Hoffman et al. ..... 340/573.1
5,812,056 A * 9/1998 Law ..... 340/539.15
6,300,875 B1 * 10/2001 Schafer ..... 340/573.1
6,650,241 B2 * 11/2003 Osborne et al. ..... 340/573.1
6,828,908 B2 * 12/2004 Clark ..... 340/539.13
7,034,683 B2 * 4/2006 Ghazarian ..... 340/568.1
2005/0253707 A1 * 11/2005 Clarke et al. ..... 340/539.15

* cited by examiner

*Primary Examiner*—Daniel Previl
(74) *Attorney, Agent, or Firm*—D. Peter Hochberg; Sean F. Mellino; Daniel J. Smola

(57) ABSTRACT

A locator system for locating a person, animal or mobile object for use with a cellular network, the locator system including a fob containing a GSM transceiver for communication with the cellular network, a GPS unit for indicating the location of a person, animal or object being searched for, a baseband processor for controlling electronic modules in the fob and an RF beacon for transmitting strong ID signals in pulse form for indicating the direction and location of the fob. The system can operate with a call center to which communications are made by a guardian seeking assistance in finding the lost person, animal or object, which in turn communicates with the cellular network to send signals to activate the fob and which receive signals from the fob. Mobile or handheld tracking units pick up GPS and RF beacon signals to find the fob. The locator system can be used in combination with a residential locating system.

29 Claims, 6 Drawing Sheets

RF BEACON ROUTINE

LOCATOR SYSTEM

CROSS REFERENCE TO RELATED APPLICATION

This application is a continuation-in-part of U.S. patent application Ser. No. 10/676,452 filed Oct. 2, 2003.

BACKGROUND OF THE INVENTION

1. Field of the Invention

The present application relates to a locator system for locating a person, animal or mobile structure whose whereabouts is sought, either because a person, animal or structure is lost, abducted or for any other reason that the location is sought.

2. Description of the Prior Art

Numerous systems relating to containing, communicating with and locating children, older persons and animals are well known. One type of system includes a loop of wire for which an alarm is actuated if a person or animal wearing an appropriate device goes near or crosses the loop. See U.S. Pat. No. 3,753,421 (Peck, 1971), U.S. Pat. No. 4,745,882 (Yarnall, Sr., et al., 1988) and U.S. Pat. No. 6,650,241 (Osborne et al., 2003). Other security, locating and monitoring systems are disclosed in U.S. Pat. No. 3,980,051 (Fury, 1976), U.S. Pat. No. 5,714,932 (Castellon et al., 1998), and U.S. Pat. No. 5,812,056 (Law, 1998). There are also a number a devices around involving collars with electrical systems that are used primarily for training pets. Such type of collars are disclosed in U.S. Pat. No. 4,202,293 (Gonda et al., 1978), U.S. Pat. No. 4,335,682 (Gonda et al., 1982), U.S. Pat. No. 4,794,402 (Gonda et al., 1988) and U.S. Pat. No. 5,161,485 (McDade, 1992). U.S. Pat. No. 3,980,051 (Fury, 1976) is directed to an animal training system wherein a pulse transmitter and receiver are included in the first housing in the vicinity of a dog or pet master disposed in a housing worn by the pet for receiving a pulse sound from the transmitter which repeats the pulse and transmits it back to the receiver in the first housing; if the pet moves beyond a certain distance and no response is received, a dog whistle is actuated to signal the animal to return. Various monitoring and locating systems are known, such as those disclosed in U.S. Pat. No. 5,714,932 (Castellon et al., 1998) and U.S. Pat. No. 5,812,056 (Law, 1998).

Cellular telephones are extremely well known and used throughout the world. Cellular telephones are electronic transceivers having a display, a keypad, a microphone speaker and related electronics. The transceiver uses a standard protocol which is often a code division multiplex access (CDMA) or a Global System for Mobile communication (GSM). GSM communications are the most popular standard for mobile telephones in the world. They are used by 1.5 million people in over 200 countries and territories. The signalling and speech channels of GSM are digital. About 70% of the world's market in mobile telephone systems uses the GSM protocol. GSM is a cellular network to which connection is made by cellular phones looking for cells in their vicinity. Most GSM networks operate at 900 MHz or 1800 MHz bands. In some parts of the United States and Canada, they operate at 850 MHz or 1900 MHz because the other two frequency bands had already been allocated.

Global positioning systems (GPS) are well known satellite navigation systems. GPS is funded by and controlled by the U.S. Department of Defense. GPS provides specially coded satellite signals that can be processed in a GPS receiver, enabling the receiver to compute position in longitude, in latitude and altitude There are many satellites that orbit the earth in respective fixed orbits. GPS navigation is widely used, and GPS devices are available in automobiles, handheld devices and the like. Space vehicles (SV) transmit to microwave carrier signals carrying the navigation message and the standard positioning service (SPS) code signals. Baseband processors are also well known for, in effect, actuating a GPS unit for, in effect, requesting the GPS unit to update itself.

SUMMARY OF THE INVENTION

An object of the present invention is to provide an improved system for locating a person, animal or other mobile structure hereinafter referred to as a "child."

Another object of the present invention is to provide a system for locating a child whose whereabouts is unknown.

A still further object of the present invention is to provide a system for locating a child wearing an electronic unit which can transmit electronic signals the source of which can be detected using an appropriate device.

It is still a further object of the present invention to locate a missing child by determining the direction from a locating unit the child is located as well as the distance from a particular location.

It is yet still another object of the present invention to provide an electronic locating device which accurately locates a child wearing a component of the system which is not easily detected by third parties.

A further object of the invention is to provide an electronic locating system which is compact and economical, and both effective and efficient in operation.

The foregoing objects are obtained by an electronic system incorporating a unit worn by a child which is very similar to a cellular telephone, lacking, however, a display, a keypad, a microphone, and speaker. The device, referred to herein as a "fob," includes a GSM transceiver, a GPS unit, a baseband processor and an independent radio frequency (RF) tracking beacon transmitter which is independent of the GSM transceiver. The "fob" is monitored via the cellular telephone network by a call center. The child's mother, babysitter, teacher or the like (hereinafter referred to as the "guardian") contacts the call center in the event that the guardian does not know the child's location and is looking for the child's whereabouts. The call center could be a private enterprise set up for the purpose of monitoring safety and security systems such as: ADT, Brinks, On-star, etc., or it could be the local police department, fire department, EMS, state highway patrol, FBI or other safety agency. The guardian contacts a call center or the police using a global communication network, such as the Internet, or their telephone or cell phone. The call center, which constantly monitors the cellular network, locates the GSM fob and the cellular tower in the vicinity of the fob. A signal is transmitted to the fob which causes the baseband processor to send the "last known" GPS coordinates to the call center where they are displayed using mapping software. The baseband processor then activates or wakes up GPS module and requests it to take a "current position" reading. When the fob completes the reading, the GPS coordinates are sent via the cellular telephone network back to the call center where they can be displayed on a computer screen using mapping software. If the "current position" reading cannot be obtained, the signal back to the call center indicates that the GPS cannot capture new coordinates. If the call center sees the position change rapidly as in an abduction, appropriate authorities can be instructed to intercept the perpetrators. The call center can also send a command signal to the fob's baseband processor, over the cellular phone network, to activate the independent RF tracking beacon transmitter in the fob, the RF tracking beacon being independent from the cellular network transceiver. The RF tracking signal (hereinafter referred to as the "RF Beacon"), is transmitted by the child's fob and can be tracked by a mobile tracking unit (MTU) which could be attached, for example, to a police car, or other rescue vehicle, and/or a handheld tracking unit (HHTU). The MTU and the HHTU include a highly directional antenna which locates the direction from which the RF Beacon signal is coming and its strength. The "lost" signal from the cellular tower furthermore causes the GPS module to obtain a new set of coordinates which are sent back to the call center. The GPS in the fob sends out a burst of readings which indicate whether the fob is in a fixed location or is traveling, for example, in a car.

DESCRIPTION OF THE PREFERRED EMBODIMENT

Figure 1:
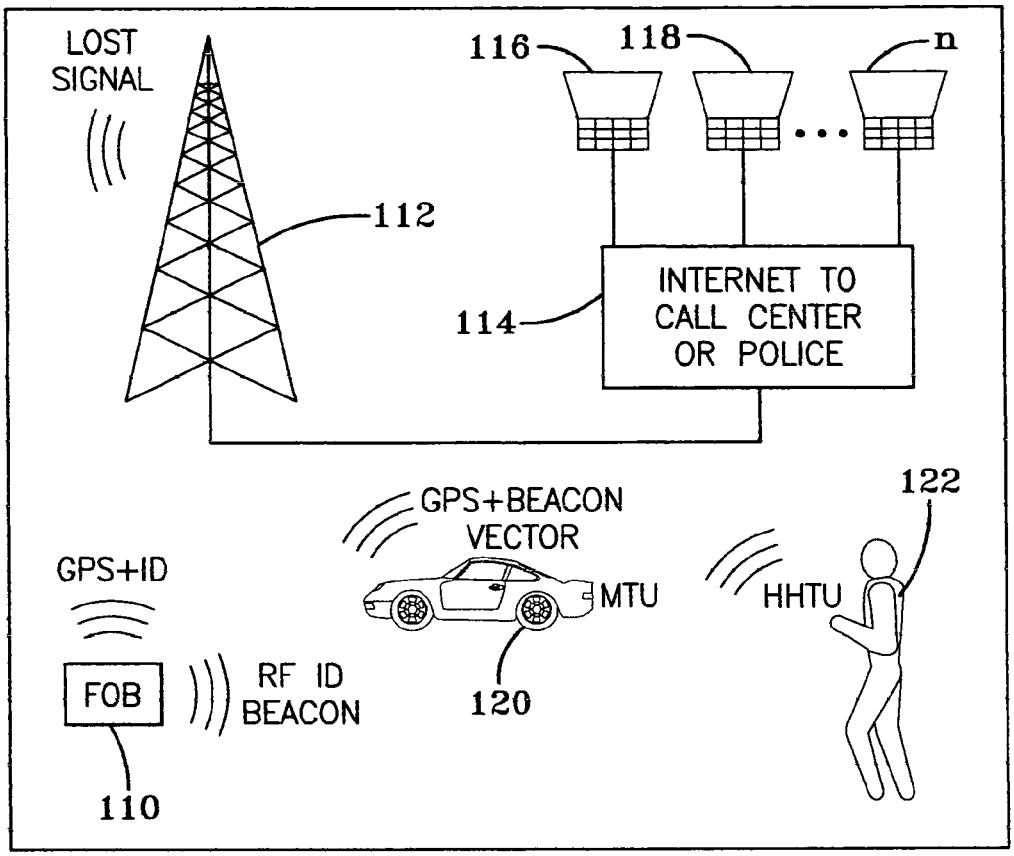
FIG. 1 is a general overview of the locator system according to the invention.
Figure 2:
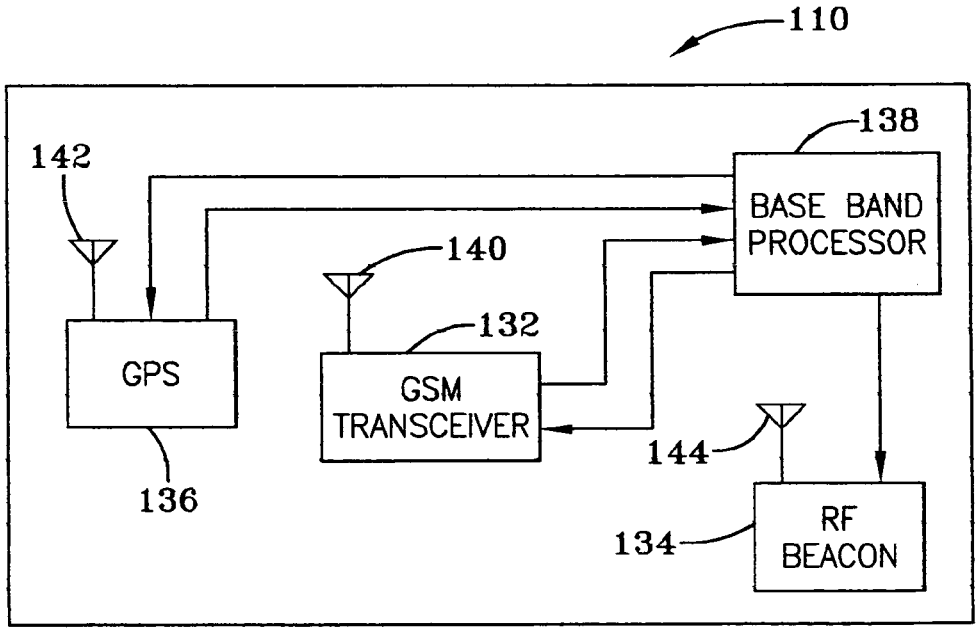
FIG. 2 shows in block form the electronic components of a fob according to the invention.

The overall system is shown in general form in FIG. 1. FIG. 1 depicts a fob 110 which, as described below, includes a baseband processor, an RF beacon, a GPS receiver and a GSM transceiver. The fob includes an electronic circuit which is battery powered and, preferably, has circuitry for limiting the use of power to maximize the TBC (Time Between Charge) for the battery. The fob incorporates a standard communication protocol for electronically connecting the fob 110 to a cellular network which includes a group of cellular towers usually having a group of cellular towers connected to a local switching hub which is in turn connected to other local switching hubs so that each cellular tower is part of the cellular network. Fob 110 is operatively connected with a cellular tower 112 which is usually the closest cellular tower to fob 110. A call center 114 is operatively electronically connected to the cellular network and, in turn, to cellular tower 112. Each child's guardian can be electronically connected to call center 114 by means of an Internet connection through the guardian's respective computer 116, 118, . . . n, or by using a cell phone or standard telephone. When a child's guardian believes that the child is lost or for some reason does not know the child's whereabouts, the guardian sends a message via the Internet from the guardian's respective computer 116 to call center 114, or calls the call center using a 1-800-NNN-NNNN number (that is, any telephone number and preferably a toll free number). The call center 114 sends a signal to the cellular network, and cellular tower 112 emits a "lost" signal on a GSM radio frequency having a particular ISN (Identification System Number) which is received by the GSM transceiver of fob 110. When the baseband protocol processor receives the correct ISN number and the "lost" command, the protocol processor activates the GPS module, which then obtains readings that are transmitted via the cellular link to call center 114. The protocol processor also turns on the independent RF tracking beacon transmitter, and the latter module transmits RF signals having a particular identification for, among other things, identifying the fob and sending out signals with the ID that can be tracked by an MTU and an HHTU. The RF tracking beacon transmitter is independent from the GSM transceiver. The GPS indicates the location of the fob (and the child). If the GPS readings are not able to be updated, such as in a metal building, the RF beacon can be tracked to indicate the direction and relative distance to the fob (and the child), from the respective MTU 120 and HHTU 122. The RF beacon transmits a signal having a digital packet of data including: a unique registered ID number, a status byte and a check sum. The ID number is linked to various personal information in the call center database, including such items as the identity of the child, a picture of the child, the home address of the child, the child's height, the child's weight, color of the child's eyes, etc. This provides authorities with the overall identity of the child wearing the fob. FIG. 2 shows fob 110 in more detail. Fob 110 has two RF modules, a GSM module 132, which is a transceiver, and an independent RF tracking beacon transmitter module 134. Fob 110 further has a GPS receiver module 136. Modules 132, 134 and 136 are controlled by a baseband protocol processor 138. Fob 110 is, as noted earlier, essentially a cellular telephone lacking a display, keypad, microphone, and speaker. GSM 132 has an antenna 140 which is part of a cellular network telephone standard.

GSM 132 is in periodic communication with a cellular tower 112 when the circuitry in fob 110 is in its ON mode. GPS 136 has an antenna 142 for receiving electronic signals from Global Positioning Satellites. GPS units are well known in the cellular telephone market and have been incorporated into cellular phones. A GPS network comprises multiple satellites orbiting around the earth in generally fixed orbits, and there are usually from three to five satellites in orbit which participate in determining the location of a GPS receiver. GPS 136, like other GPS units, has a processor for comparing the time stamp and phase from the satellite signals in order to calculate the coordinate position of the GPS receiver. GPS 136 incorporates and utilizes a software algorithm for determining three-dimensional coordinates based on received satellite signals.

GPS 136 is under the control of baseband protocol processor 138. In normal use, protocol processor 138 is normally inactive, but periodically (for example, every five minutes) protocol processor 138 in effect instructs GPS 136 to obtain a new set of coordinates which it accomplishes using a standard software algorithm incorporated therein. Baseband processor 138 controls RF beacon 134 as noted above and as explained in more detail below.

RF beacon 134 includes an antenna 144. When activated, RF beacon 134 emits RF signals in all directions through antenna 144. RF beacon 134 sends out strong, pulsed signals having a tracking code. The signals are sent out at about three to five times per second, according to the preferred embodiment of the invention. RF beacon 134 for each fob has its own unique identification tracking code. According to the preferred embodiment of the invention, the tracking code has a number of bytes. These consist of a "SYNC" byte, four "ID" bytes, a "CODE" byte and a "CHECK SUM" byte. The tracking code is preferably sent at 57.6 KBd (kilobaud) rate, which takes about 1 ms (millisecond) to send. RF beacon 134 has two special characteristics. First, the current bias to the RF power amp in RF beacon 134 can be changed to boost the transmitter by a factor, such as in the preferred embodiment of 100. As explained below, this is done in order to conserve the power of the battery for the electronics in fob 110 so that a very high power signal can be generated for a short period of time with a low-duty cycle. The other characteristic is that each signal sent by RF beacon 134 is a unique signal. For a four-byte length, there are 4,294,967,296 unique ID codes available for each fob.

According to the preferred embodiment of the invention, RF beacon 134 emits ID/data packet signals having an ID/data packet of from six to eight bytes in length, preferably seven bytes in length. Each byte includes a binary code. Preferably four bytes designate the ID number. One byte is a status byte that indicates, for example, the battery charge level and whether or not the GPS signal is "new updated" or old, "last known" coordinates saved in memory. The final byte is a "CHECK SUM" byte, or a cyclical redundancy checking (CRC) byte to provide a way to verify the accuracy of the received ID/data packet signal.

Figure 3:
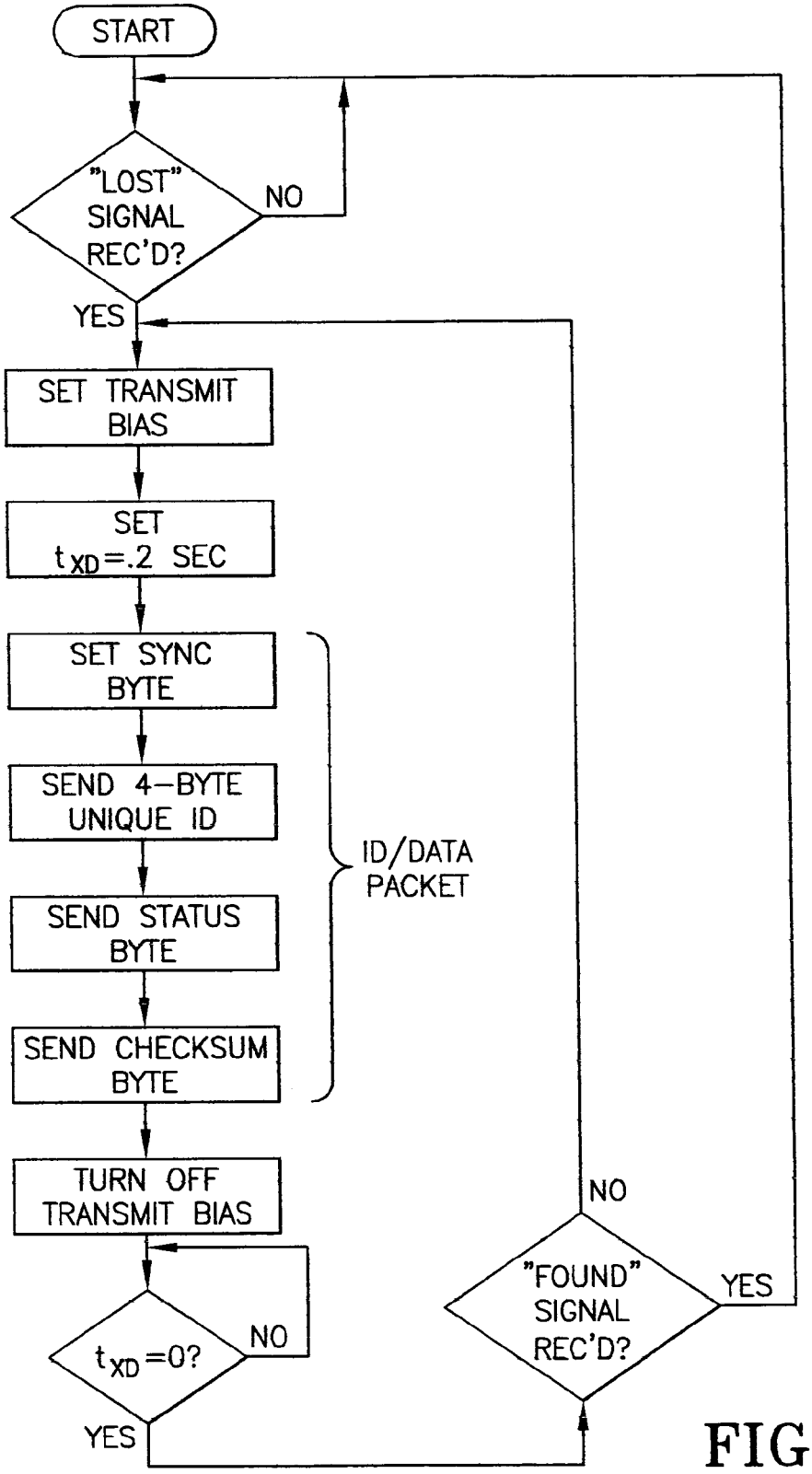
FIG. 3 is a flow diagram showing the functioning of the RF beacon incorporated in the locator system according to the invention.
Figure 4:
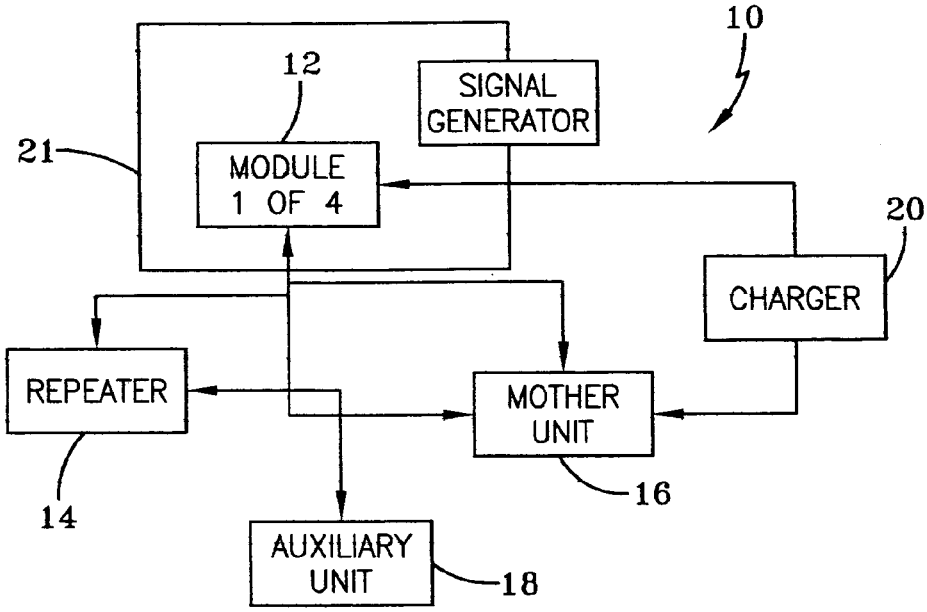
FIG. 4 is a schematic diagram of a residential locating system forming part of the present invention.
Figure 5:
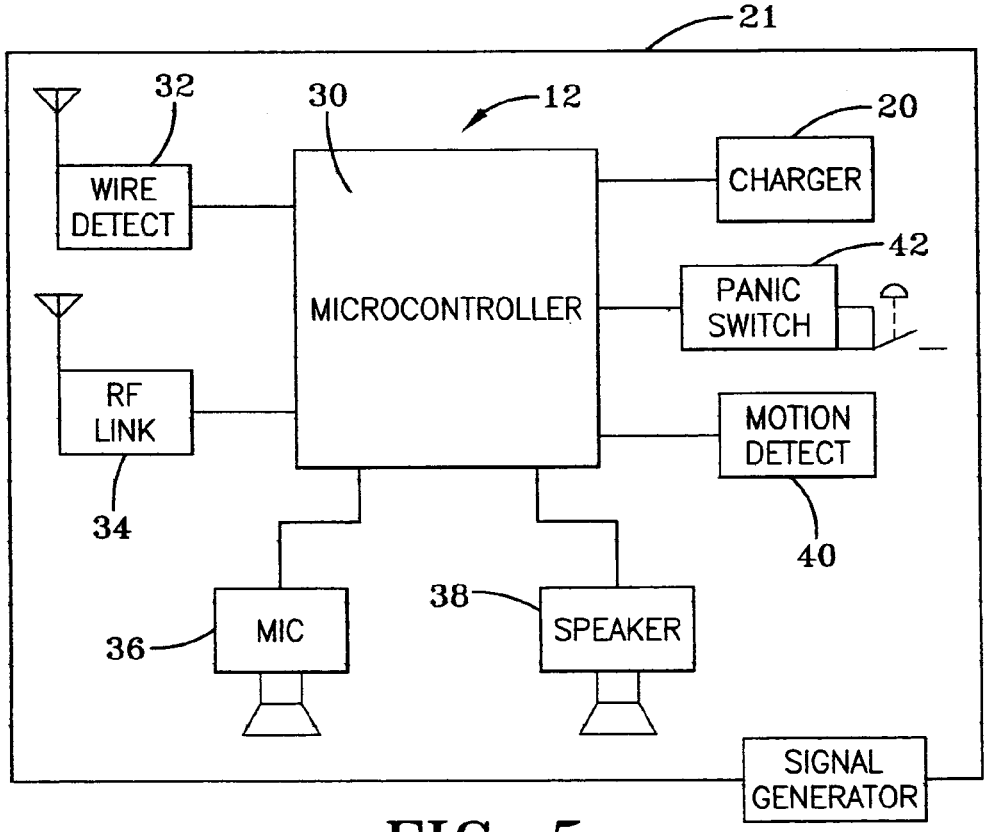
FIG. 5 is a schematic diagram of a child monitoring module utilized by the system shown in FIG. 4.
Figure 6:
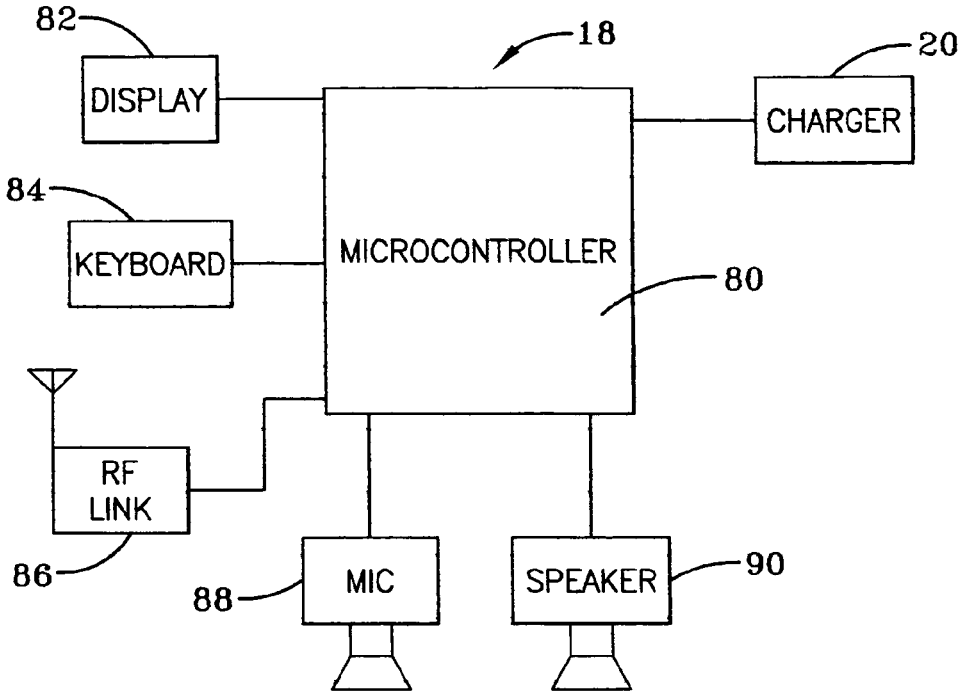
FIG. 6 is a schematic diagram of the repeater utilized by the system shown in FIG. 4.
Figure 7:
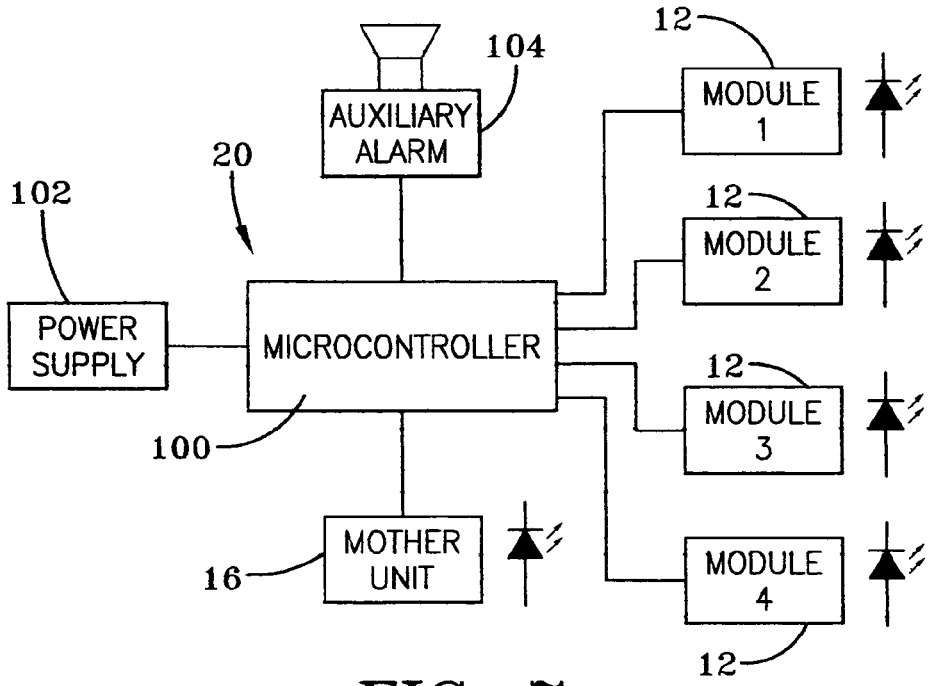
FIG. 7 is a schematic diagram of the control unit utilized by the system shown in FIG. 4.
Figure 8:
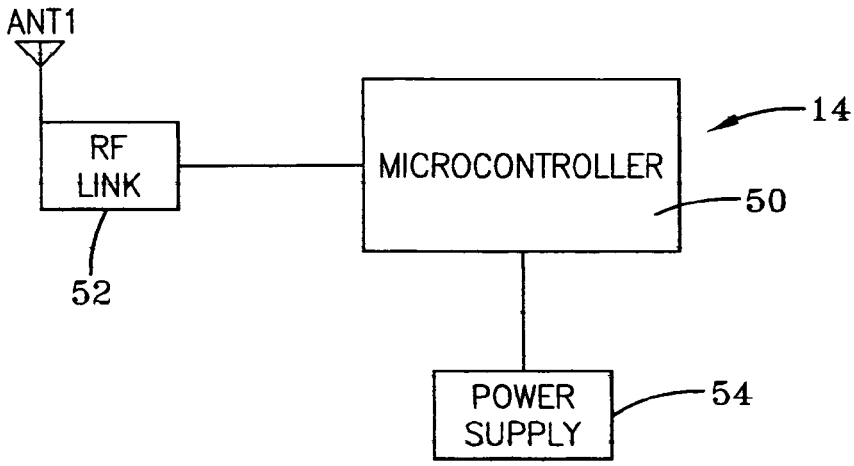
FIG. 8 is a schematic diagram of the auxiliary power unit utilized by the system shown in FIG. 4.
Figure 9:
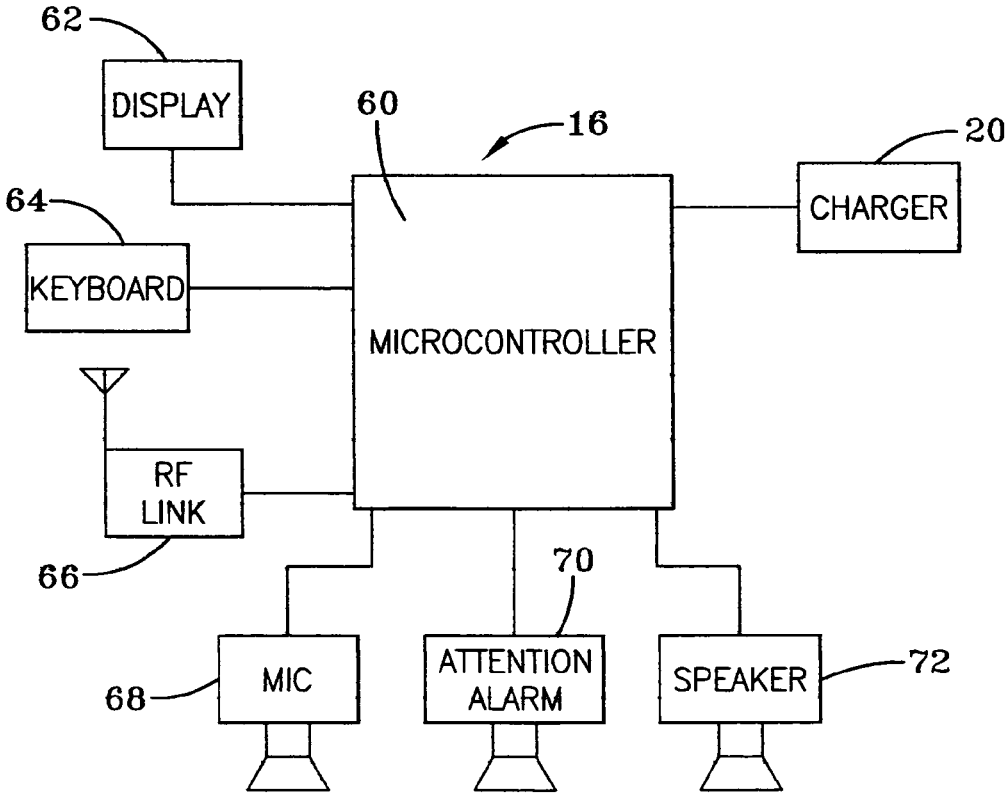
FIG. 9 is a schematic diagram of the battery charger utilized by the system shown in FIG. 4.
Figure 10:
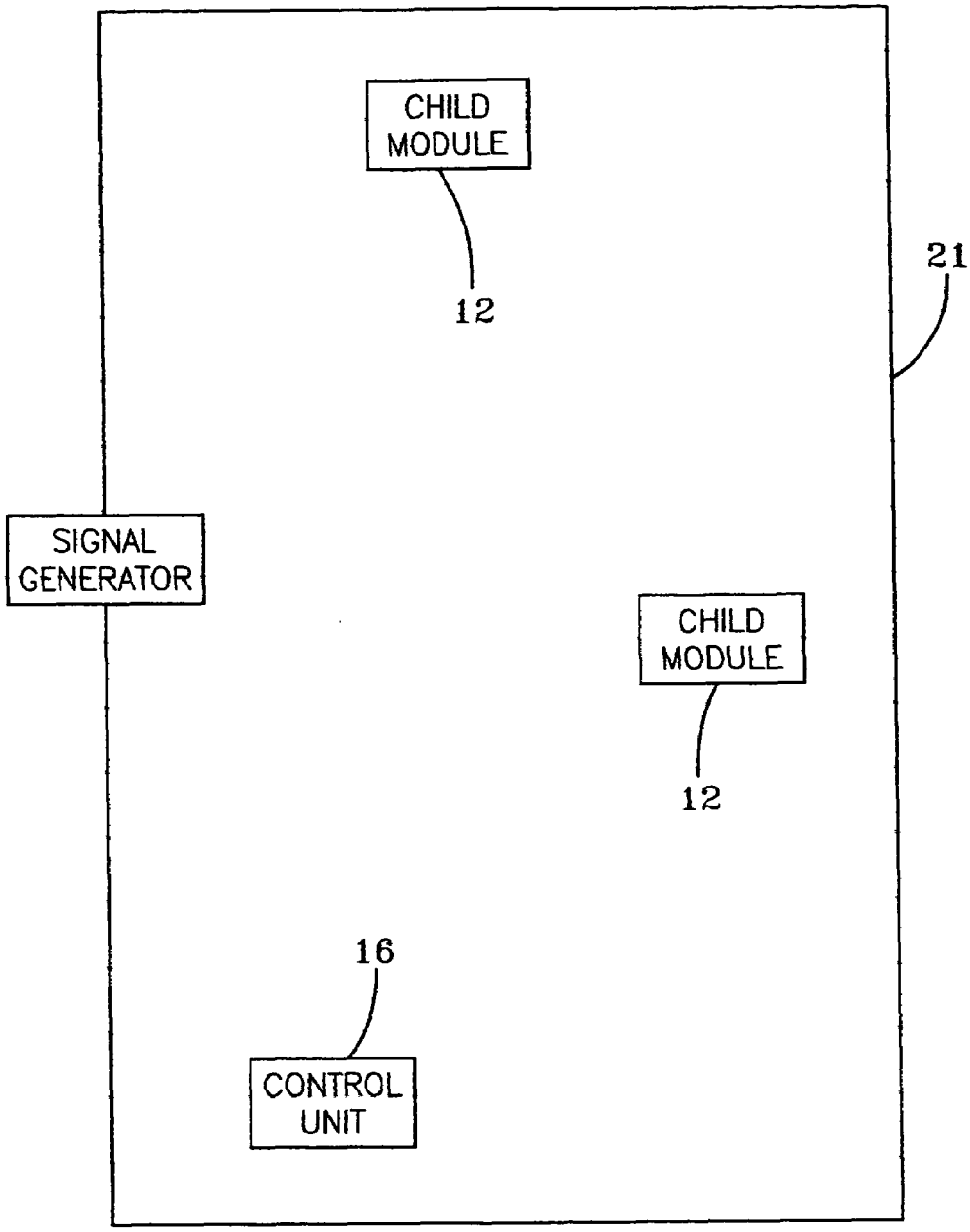
FIG. 10 is a schematic diagram of the system shown in FIG. 4.

FIG. 3 is a flow diagram showing the operation of RF beacon 134. If a "lost" signal has not been received by the fob, the RF beacon remains in an inactive state. However, if a "lost" signal has been received, the transmit bias is activated (which turns on the RF beacon transmitter). Next, a transmit delay (txd) timer is initialized for a period of time; in this case, it sets a countdown time of 0.2 seconds (five times per second). An ID/data packet is transmitted to the one or more tracking units, i.e. HHTU and/or MTU. The units can then track the "lost" fob. The four-byte unique ID signal is sent to the tracking unit(s) to identify the fob. The status byte indicates battery level and the GPS coordinate status ("new" or "last known"). The CHECK SUM byte is sent to the tracking unit(s) to verify that the data they received is correct. The transmit bias is turned off. Next, if the transmit delay (txd) has not yet run out, that is, the transmit delay of 0.2 seconds has not yet expired, the system continues to function until it has run out. When the 0.2 second transmit delay time has elapsed, the baseband processor checks to see if a "found" signal has been received. If a "found" signal has been received, the baseband processor leaves the RF bias and the RF beacon is turned off and waits for the next "lost" signal. If a found signal has not yet been received, the RF beacon is activated and sends ID/data packet signals as before using the ID/data routine again.

According to the preferred embodiment of the invention, RF beacon 134 has the following characteristics:

1. The transmitter of RF beacon 134 operates on a 915 MHz ISM (Industrial Scientific Medical) RF band;

2. The channel width is 200 KHz;

3. The FM modulation limits are 25 KHz;

4. The baud rate is 57.6 KBd (17.6 u Sec./bit)

5. The number of channels has a 120 limit from 902 MHz to 926 MHz. It is desirable to limit the channels to 40 or less, depending on the "FHSSS" (frequency hopping sequential spread spectrum) specification allowing for higher power transmission. The number of channels should be limited to the least possible to reduce search-lock latency.

6. The RF power input is 1 mW for the normal mode, and 100 mW for the tracking mode FHSSS;

7. There is PA biasing for 1 mW and 100 mW;

8. There is a search mode trigger for High Power FHSSS mode operation; and

9. There is channel setting when units are in the charger base. This is done through voltage pins or with a separate 3-wire SPI connector (TPD).

Referring back to FIG. 1, the fob's ID/data RF signal is intended to be received by an MTU and an HHTU. In its preferred form, the MTU includes five components which are connected together for carriage by a vehicle to enable the tracking of a particular fob. These five components include a computer, preferably a laptop computer, an electronic magnetic compass, a GPS receiver, a rotating, high-gain, highly-directional, narrow beam antenna with a receiver, and a cellular phone system transceiver link. The laptop computer screen preferably shows an area map, the cellular tower ID, the orientation and position of the tracking vehicle, the GPS fob position and the directional vector from the vehicle to the fob. This screen would also show the intersection of two or more tracking vehicle directional vectors. In its preferred form, the electronic compass is included in a dome on top of the vehicle, as is the GPS receiver and the directional beam antenna. A stepper motor rotates the directional beam antenna to provide the tracking of the fob signal. The design of the tracking antenna and receiver sensitivity are critical to achieving precise performance in the field. The sensitivity of the tracking receiver is preferably adjustable from 0 db to 120 db. This range enables the tracking at large distances without overloading when near the fob being tracked. It is preferable that the beam spread be about ±15° to allow for a reasonable half-power point angle to determine true vector position.

Likewise, the HHTU uses a similar high-gain, highly-directional, narrow beam antenna with receiver that is used in the MTU. This arrangement allows duplication of circuitry and antennae in both the MTU and HHTU to make both units more economical. In its preferred form, the HHTU has a pistol grip with an LCD display to show key information including relative signal strength, fob ID number, GPS coordinates and other search parameters.

In use, if a guardian cannot find a child, the guardian would either call the local police to let them commence the tracking and/or contact a private security company to perform the call handling and the initial tracking and/or having an Internet log-in for the customer to track the fob. A cellular service provider could initially set up whatever system is deemed to be best for customer satisfaction and efficient and effective use. As the systems are developed, it would be advantageous if the cost could be kept low even though the operation is effective and efficient.

Another type of a monitoring, communication and locating system is disclosed in U.S. patent application Ser. No. 10/676,452 filed on Oct. 2, 2003, and incorporated herein by reference. This patent application discloses a monitoring, communication and locating system 10 (referred to herein as a residential locating system) in which a wire 21 defines the periphery of a child-containment area. Wire 21 emits electronic signals defining the periphery of the pet-containment or child-containment area. A wire detector 32 detects the electronic signals. System 10 also includes a control unit 16 and a child module, i.e., a fob, having a child-module microcontroller 30 and a child-module transceiver, or RF link, 34. The system can also include a motion detector system 40, an audio communication system having a microphone 36 and a speaker 38, a directional and distance locating system or RF link 34. RF link 34 generates RF signals in all directions and is particularly useful if the child leaves the containment area defined by wire 21. In this situation, RF link 34 generates a unique radio frequency or channel, and the guardian with a control unit 16 could move or sweep the control unit with its directional antenna in a path, such as a circular arc, to detect the strongest signal emitted by the child module or fob. This signal indicates the direction from which the strongest signal was detected to determine where the child is located, and the strength of the signal would indicate its distance.

The latter system is for generally shorter distances than the system described with reference to FIGS. 1-3. The mother unit or control unit 16 of the residential locating system is usually monitored and operated by a guardian, and via a call center It is possible to combine the system shown in FIGS. 1 and 2 with that shown in FIGS. 4-7. This could cover the situation where a guardian was watching one or a number of children (including animals, as noted earlier) and would want to monitor them in both nearby locations and in distant locations. It would be possible to have a single control unit for both systems and tracking units which could be used with both systems as well.

The invention has been described in detail with particular emphasis being placed on the preferred embodiment thereof, but variations and modifications may occur to those skilled in the art to which the invention pertains.

We claim:

1. A fob for use with a cellular network and a global positioning system, said fob comprising:

a cellular network transceiver for establishing a telecommunications link with the cellular network;

a global positioning system receiver for generating an output of GPS location coordinates of said global positioning system;

an independent radio frequency tracking beacon transmitter actuable for transmitting ID/data radio frequency signals, said independent radio frequency tracking beacon transmitter being independent from said cellular network transceiver, and said ID/data radio frequency signals having an identification code for identifying said independent radio frequency tracking beacon transmitter; and a protocol processor for electrically controlling said global positioning system, receiver, said cellular network transceiver and said independent radio frequency tracking beacon transmitter, and said protocol processor sending control signals to said independent radio frequency tracking beacon transmitter to cause said independent radio frequency tracking beacon transmitter to transmit ID/data radio frequency signals for detection by one or more tracking unit(s).

2. A fob according to claim 1 wherein said independent radio frequency tracking beacon transmitter includes a radio frequency power amplifier for increasing the power output of said independent radio frequency tracking beacon transmitter when said radio frequency transmitter is transmitting signals to be detected for locating said independent radio frequency beacon transmitter.

3. A fob according to claim 2 wherein said independent radio frequency tracking beacon transmitter incorporates a frequency-hopping sequential spread-spectrum protocol.

4. A fob according to claim 2, and where the independent radio frequency tracking beacon transmitter transmits a low duty cycle, pulsed, ID/data tracking signal.

5. A fob according to claim 1 wherein said independent radio frequency tracking beacon transmitter transmits ID/data radio frequency signals having a predetermined number of bytes selected to provide each independent radio frequency tracking beacon transmitter with a unique identity code.

6. A fob according to claim 5 wherein each independent radio frequency tracking beacon transmitter transmits an ID/data radio frequency signal having at least one identity byte.

7. A fob according to claim 5 wherein each independent radio frequency tracking beacon transmitter transmits an ID/data radio frequency signal having at least one byte indicative of the status of some electronic component of at least one of the circuitry including said independent radio frequency tracking beacon transmitter, said global positioning system and said baseband processor.

8. A fob according to claim 1 wherein said protocol processor sends signals for activating said global positioning system to generate an output indicating the newest or the last-known GPS location coordinates of said global positioning signal in response to signals received by said cellular network transceiver from the cellular network.

9. A fob according to claim 1 wherein said protocol processor sends signals for activating said independent radio frequency tracking beacon transmitter in response to the absence of signals from the cellular network for a predetermined period of time.

10. A fob according to claim 1 for further use with an electronic apparatus having a wire defining a periphery of a containment area and a generator to apply an electronic signal to the wire, the wire transmitting a first radio frequency signal, said fob further comprising:

a periphery wire detector circuit for detecting a first radio frequency signal from the periphery wire and for generating wire detector signals to said protocol processor to activate said independent radio frequency tracking beacon transmitter.

11. A fob according to claim 1 for further use with an electronic apparatus having a wire defining a periphery of a containment area and a generator to apply an electronic signal to the wire, the wire transmitting a first radio frequency signal, said fob further comprising:

a periphery wire detector circuit for detecting a first radio frequency signal from the periphery wire and for generating wire detector signals to said protocol processor to activate said independent radio frequency tracking beacon transmitter and said cellular network transceiver, for detection by one or more tracking units and to send signals reflective of the wire detector signals to the cellular network, respectively.

12. A fob according to claim 1 and further comprising a motion detector circuit for generating a motion-stationary signal to said protocol processor for activating said independent radio frequency tracking beacon transmitter in response to a lack of motion of said fob for a predetermined period of time.

13. A fob according to claim 1 and further comprising circuitry for generating signals indicating a fob voltage level to said protocol processor for activating said independent radio frequency tracking beacon transmitter in response to a predetermined fob voltage level.

14. A fob according to claim 1 and further comprising a motion detector circuit for generating a motion-stationary signal to said protocol processor for activating said independent radio frequency tracking beacon transmitter and cellular network transceiver in response to a lack of motion of said fob for a predetermined period of time, to send signals reflective of the lack of motion of said fob, for detection by one or more tracking units and to the cellular network, respectively.

15. A fob according to claim 1 and further including:

monitoring and specific status code generating circuitry to monitor characteristics and generate specific status codes to said protocol processor for a group consisting of at least one of proximity to a periphery wire, absence of fob motion, absence of radio frequency signal for a predetermined period of time and the voltage level of the fob;

said protocol processor being responsive to said monitoring and specific status code generating circuitry for activating said independent radio frequency tracking beacon transmitter to transmit the respective status codes; and a residential control unit transceiver operatively connected to said independent radio frequency tracking beacon transmitter for receiving and indicating the respective status codes.

16. A fob according to claim 1 and further including:

monitoring and specific status code generating circuitry to monitor characteristics and generate specific status codes to said protocol processor for a group consisting of at least one of proximity to a periphery wire, absence of fob motion, absence of radio frequency signal for a predetermined period of time and the voltage level of the fob;

said protocol processor being responsive to said monitoring and specific status code generating circuitry for activating said network cellular transceiver to transmit said respective status codes to the cellular network.

17. A fob for use with a cellular network, said fob comprising:

a cellular network transceiver for establishing a telecommunications link with the cellular network;

an independent radio frequency tracking beacon transmitter actuable for transmitting ID/data radio frequency signals, said independent radio frequency tracking beacon transmitter being independent from said cellular network transceiver, and said ID/data radio frequency signals having a tracking code for identifying said independent radio frequency tracking beacon transmitter; and a protocol processor for electrically controlling said independent radio frequency tracking beacon transmitter, said protocol processor sending control signals to said independent radio frequency tracking beacon transmitter to cause said independent radio frequency tracking beacon transmitter to transmit ID/data radio frequency signals for detection by a tracking unit.

18. A fob according to claim 17 wherein said independent radio frequency tracking beacon transmitter includes a radio frequency power amplifier for increasing the power output of said independent radio frequency tracking beacon transmitter when said independent radio frequency tracking beacon transmitter is transmitting signals to be detected for locating said independent radio frequency tracking beacon transmitter.

19. A fob according to claim 18 wherein said independent radio frequency tracking beacon transmitter incorporates a frequency-hopping sequential spread-spectrum protocol.

20. A fob according to claim 18, and where the independent radio frequency tracking beacon transmitter transmits a low duty cycle, pulsed, ID/data tracking signal.

21. A fob according to claim 17 wherein said independent radio frequency tracking beacon transmitter transmits ID/data radio frequency signals having a predetermined number of bytes selected to provide each independent radio frequency tracking beacon transmitter with a unique identity code.

22. A fob according to claim 21 wherein each independent radio frequency tracking beacon transmitter transmits an ID/data radio frequency signal having at least one identity byte.

23. A fob according to claim 22 wherein each independent radio frequency tracking beacon transmitter transmits an ID/data radio frequency signal having at least one byte indicative of the status of some electronic component of at least one of the circuitry including said independent radio frequency tracking beacon transmitter and said baseband processor.

24. A fob according to claim 17 wherein said protocol processor sends signals for activating said independent radio frequency tracking beacon transmitter in response to the absence of signals from the cellular network for a predetermined period of time.

25. A fob according to claim 17 for further use with an electronic apparatus having a wire defining a periphery of a containment area and a generator to apply an electronic signal to the wire, the wire transmitting a first radio frequency signal, said fob further comprising:

a periphery wire detector circuit for detecting a first radio frequency signal from the periphery wire, and for generating wire detector signals to said protocol processor to activate said independent radio frequency tracking beacon transmitter.

26. A fob according to claim 17 for further use with an electronic apparatus having a wire defining a periphery of a containment area and a generator to apply an electronic signal to the wire, the wire transmitting a first radio frequency signal, said fob further comprising:

a periphery wire detector circuit for detecting a first radio frequency signal from the periphery wire and for generating wire detector signals to said protocol processor to activate said independent radio frequency tracking beacon transmitter and to said cellular network transceiver, for detection by one or more tracking units and to send signals reflective of the wire detector signals to the cellular network, respectively.

27. A fob according to claim 17 and further comprising a motion detector circuit for generating a motion-stationary signal to said protocol processor for activating said independent radio frequency tracking beacon transmitter in response to a lack of motion of said fob for a predetermined period of time.

28. A fob according to claim 17 and further comprising a motion detector circuit for generating a motion-stationary signal to said protocol processor for activating said cellular network transceiver in response to a lack of motion of said fob for a predetermined period of time, to send signals reflective of the lack of motion of said fob to the cellular network.

29. A fob according to claim 17 and further comprising circuitry for generating signals indicating a fob voltage level to said protocol processor for activating said independent radio frequency tracking beacon transmitter in response to a predetermined fob voltage level.

* * * * *